United States Patent [19]

Lockwood

[11] 4,162,032

[45] Jul. 24, 1979

[54] PINWHEEL ASSEMBLY HAVING IMPROVED PINS

[76] Inventor: Frank J. Lockwood, 7011 W. Archer Ave., Chicago, Ill. 60638

[21] Appl. No.: 931,549

[22] Filed: Aug. 7, 1978

[51] Int. Cl.[2] ..... B65H 17/38

[52] U.S. Cl. ..... 226/81; 226/87

[58] Field of Search ..... 226/74–76, 226/79, 81, 87; 74/243 F; 352/157, 195; 400/616–616.3

[56] References Cited

U.S. PATENT DOCUMENTS

| | | | |
|---|---|---|---|
| 3,066,548 | 12/1962 | Shapiro | 74/243 F |
| 3,747,820 | 7/1973 | Hawxhurst | 226/76 |
| 4,022,365 | 5/1977 | Weller | 226/81 |
| 4,036,420 | 7/1977 | Lockwood | 226/81 X |

*Primary Examiner*—John P. Shannon

*Attorney, Agent, or Firm*—Robert E. Wagner; Gerald T. Shekleton

[57] ABSTRACT

A continuous form pinwheel, having pins and a platen formed of a durable plastic material, the pins being closely fitted in their seats for the exclusion of foreign matter, having a unique cam follower and radiused at their lower end. The tips of the pins may be formed of steel, thereby eliminating wear on the two major wear areas of the pin. The plastic material contributes to a low coefficient of friction and thus long life.

9 Claims, 7 Drawing Figures

PINWHEEL ASSEMBLY HAVING IMPROVED PINS

BACKGROUND OF THE INVENTION

This device relates to an apparatus for feeding paper; and, more particularly, it relates to a continuous form pinwheel adaptable to feed paper to collators, folders and interleavers, and other machines where registration can be maintained by pinwheels.

In the manufacture of paper feeding machines and the like, one of the most important parts to be constructed is the pinwheel. It is the pinwheel which drives or progresses the paper through such a machine. Because of its important function, it is imperative that the pinwheel be very accurately formed; otherwise, the paper forms being fed may become damaged or misaligned or the machine may become fouled.

Due to the nature of the particular application of feeding paper forms, no or little lubricant of any type may be used, as the particular lubricant used would be deposited on the paper surface being fed, creating an unsightly and unacceptable smear on the paper. Thus, current pinwheels present the problem of a short life and expensive manufacture.

In my prior patent, U.S. Pat. No. 4,036,420, there is disclosed a pinwheel platen formed of anodized aluminum. Such a platen contributes greatly to an inexpensive product with long life. In addition, the pins were taught as being of better wear capabilities if radiused inwardly to reduce their outside diameters at the area of greatest wear. Forming the pin of a fiberglass reinforced polycarbonate was also found to increase the wear life of the pin. However, the demands of industry for faster printing, and newly developed technology currently requires pinwheel speeds of over one thousand feet per minute, with assurances of even higher speeds in the future. At these speeds, and especially with paper of coarse fiber content, the minimal wear experienced by the polycarbonate pins at their tips is magnified to a point where, while still acceptable, requires eventual replacement of the pins. It has been found that pins formulated as taught in U.S. Pat. No. 4,036,420 when used to drive any type paper including that of coarse fiber content, experience little or no wear on the pin body. However, with paper of coarse fiber content the tip of the pin may show sufficient wear to require replacement after two months. While severe use conditions are the cause, still it is desirable to eliminate as much wear as possible, regardless of use conditions.

SUMMARY OF THE INVENTION

It is therefore an object of the subject invention to provide a novel and improved pin for use in a pinwheel for paper feeding machines and the like, which exhibits increased durability and wear life.

Another object of the present invention is an inexpensive manner of forming a wear resistant platen of the pinwheel assembly.

Yet another object of the subject invention is an improved pin for use in a pinwheel apparatus which resists wear in each of the two major wear points of a pin, the tip of the pin and the pin body sidewalls.

These and other objects are attained according to the present invention wherein the pinwheel of the present invention in one embodiment is formed of a durable plastic and, more particularly, formed of a fiberglass reinforced polycarbonate. Such a material has several advantages over the steel of the prior art and anodized aluminum, as it may be easily molded to a desired shape, it has minimal shrinkage, high strength and, with a fluorocarbon resin added, high lubricity. Thus, the platen contains all the advantages of aluminum in its lightweight characteristics and long life, while adding an ease of manufacture and a natural lubricity not found with aluminum or steel. Since it may be molded to the desired shape, with a minimum of machining, manufacturing expenses are significantly decreased. With fluorocarbon added, the friction between the pins and the platen is considerably reduced to the point where no lubricant is necessary, as with the platens of the prior art.

When used in connection with the plastic pins taught in U.S. Pat. No. 4,036,420 there is increased assurances that there will be no chattering or galling of the pins in their respective sockets. As lubricant is not necessary, should the thin film of lubricant placed on the pins as a sealing expedient dissipate or otherwise form a dry socket, the opposing surfaces of high lubricity will contact one another in a substantially frictionless travel of the pin within the socket, as though a sufficient lubricant were present.

As the pins extend and retract upon rotation of the pinwheel due to the action of the cam riding in a follower track on the base of the pin, friction is encountered on the contact of the pin with the paper when driving or feeding the paper. The tip or head of the pin is that portion driving the paper, and comprises the source of the friction. Therefore the wear from the friction due to the contact of the paper with the pin is concentrated on the tip of the pin. The subject invention in one embodiment concerns itself with the substitution of a steel tip into the plastic pin body to therefore provide the improved wearing properties which are characteristic of steel while retaining the ease of manufacture and properties of the pin body. This may be accomplished by the formation of the plastic pin body by injection molding or the like and anchoring the steel tip within the pin body.

DESCRIPTION OF THE DRAWINGS

These and other objects and advantages of the present invention will more fully appear from the following description made in connection with the accompanying drawings wherein like referenced characters refer to the same or similar parts throughout the several views in which:

Referring now to FIG. 1, a portion of a pinwheel and cylinder assembly 20 is shown. Spaced from the stationary edge support plate or fork 25 are pins 40 in various stages of emergence from their seats or sockets 41. The pinwheel assembly may itself be adjusted to cause the pins to emerge at a selected point on the circumference of pinwheel cylinder 26 by the adjustment and positioning of screw 15 within slot 16. By such a means a pair of pinwheels may be aligned. A hub 13 is keyed by keyway 14 onto a shaft (not shown). The hub secures the support plate 25 to the pinwheel assembly cylinder 26 by suitable machine screws 17 or other forms of fasteners. The edge support of plate 25 has a notched extension 12 for proper positioning and support on the suitable support assembly (also not shown). The cylinder or platen 26 in one embodiment as well as the cam assembly 61 including the camming surface 60 is formed of a plastic, preferably fiberglass reinforced polycarbonate with polytetrafluoroethylene added for lubricity and reduced surface friction as taught in the above-mentioned patent. In one form of this embodiment a mixture containing approximately 20 to 40 percent fiberglass, approximately 10 to 35 percent polytetrafluoroethylene and approximately 30 to 70 percent polycarbonate by weight, has been found to be advantageous when molded and cured. In particular, optimum results have been observed with a mixture of 28 to 32 percent fiberglass, 15 to 20 percent polytetrafluoroethylene and 45 to 50 percent polycarbonate by weight, which is injection molded and subsequently cured. Such a mixture has been found superior in terms of wearing ability, lubricity and overall long life characteristics. This superior plastic is easily molded to a desired shape and exhibits only 0.002 to 0.004 of an inch shrinkage per inch. This low shrinkage rate allows the cured plastic platen 26 and other parts to be formed with minimal additional machining to size.

Figure 1:
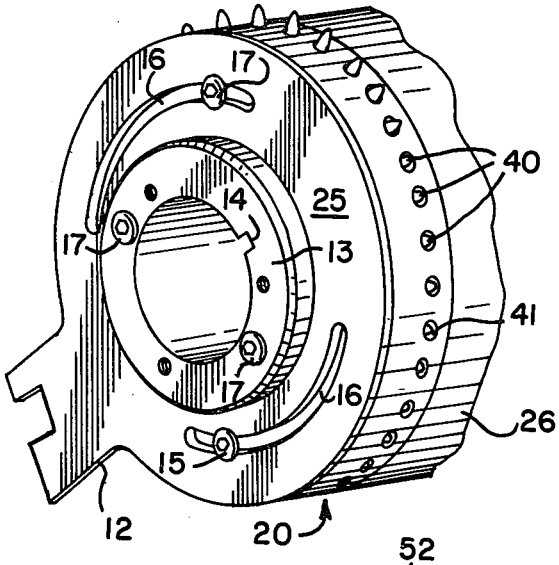
FIG. 1 shows a partial perspective view of one embodiment of the pinwheel and cylinder assembly of the present invention.

With the platen and the entire cam assembly 61 including camming surface 60 formed of such a plastic, the walls 42 of the socket or seat 41 and the follower 48 generate considerably less friction than that generated by a steel or aluminum platen socket. Thus, when used with a conventional steel pin, friction is considerably reduced in the travel of the pin in the socket. When used in combination with the polycarbonate pins taught in the above-identified patent, friction of the socket walls with the pin body may be reduced even further to become negligible in the pinwheel operation. In fact, substantially all moving parts are then formed of the polycarbonate mixture. In such an embodiment substantially all pinwheel assembly surfaces which are in moving contact with one another benefit from the inherent lubricity of the polycarbonate and thus reduce friction, heat, wear and jam-ups of the equipment, as well as increase the speed capabilities of the pinwheel feeder. Thus, assurances are greatly increased that there will be substantially no chattering or galling of the pins in their movement within the pinwheel to interfere with the operation of the pinwheel. Because of this reduced friction with the socket walls the pins may be formed to a more exacting size for a substantially precise fit within the socket and thereby exclude foreign matter such as debris, paper dust and the like, which can increase friction and wear of the opposing surface of the socket wall 42 with the pin 40. The heat caused by friction is substantially reduced, practically eliminating the attendant problems due to heat. As a direct consequence of the reduction in friction and heat, the speed of the entire pinwheel assembly can be increased to prolonged runs of 2,750 feet per minute, considerably higher than that required by present day form processing machines. In addition to the benefits gained by such a lubricitous cam follower 60, the cam assembly may revolve directly adjacent the hub 13 without the need for a bushing as is normally used.

Figure 2:
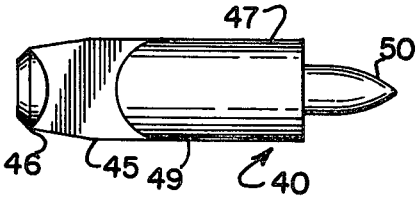
FIG. 2 shows a side elevational view of a pin of the present invention.
Figure 6:
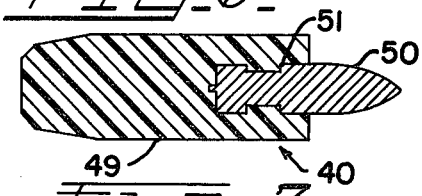
FIG. 6 is a cross sectional view taken along the lines 6—6 of FIG. 2.
Figure 7:
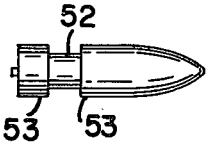
FIG. 7 is a side elevational view of a pin tip insert.
Figure 3:
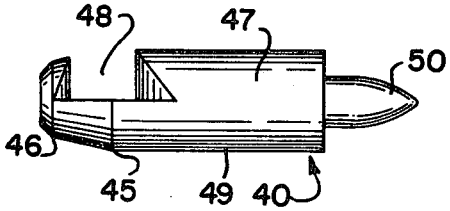
FIG. 3 shows another side elevational view of a pin taken 90° from that view shown in FIG. 2 wherein the cam track may be seen.

As shown in FIGS. 2 and 3 and 6, the pin 40 is radiused at points 45 and 46, which points are generally opposite the midpoint and interior respectively of the cam track 48. Thus the outside diameter of the pin body 49 decreases incrementally beginning at each of those points. This feature, which is taught in the aforementioned U.S. Pat. No. 4,036,420, results in decreased friction between the pin side walls and the walls of the socket in which the pin travels and thereby provides an increased pin life and decreased maintenance due to the elimination of a major wear area and resulting even distribution of the remaining wear force on the pin body.

Figure 4:
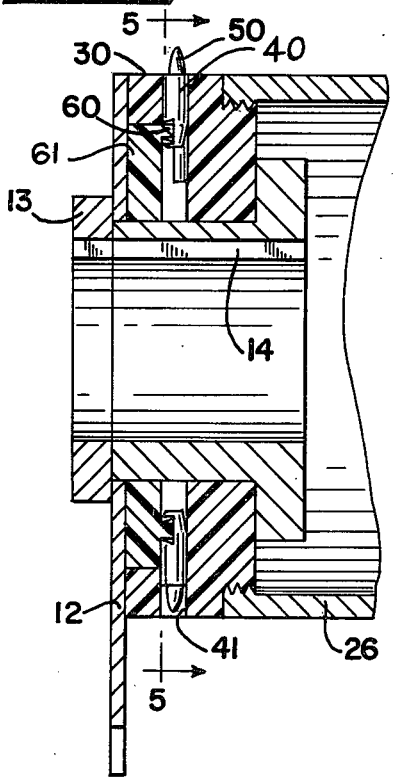
FIG. 4 is a cross section of a pinwheel and cylinder assembly of the present invention showing the relationship of the cam to the pin and in addition indicating the various parts which are plastic.
Figure 5:
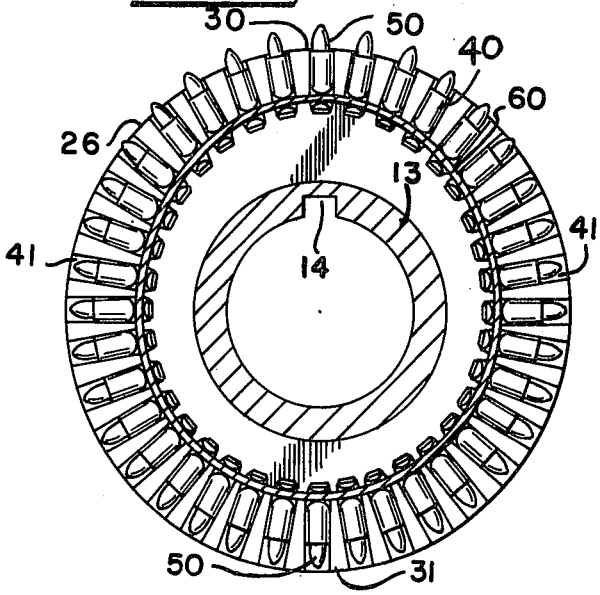
FIG. 5 is a cross sectional view taken along the lines 5—5 of FIG. 4.

FIG. 3 shows the follower 48 on the pin body 49 which acts as track upon which the camming surface 60 shown in FIG. 4, fits.

FIG. 4 shows the relationship of the pin to the cam wherein the cam assembly 61, preferably of the plastic composition as set forth above, by the action of the camming surface 60 on the follower 48 of the pin 40 causes the pin 40 to move in its socket 41 in a reciprocating action as the platen 26 revolves. Thus, as shown in FIG. 4, one pin on one side of the pinwheel will be fully extended while the pin 180° opposite the first pin on the pinwheel will be fully retracted as a result of the asymetrical shape of the camming surface 60. The camming surface is also formed of the fiberglass impregnated polycarbonate to assure a smooth travel along the pin follower 48.

By reducing friction between the socket walls 42 and the pin body walls 47 the shape of the above-described pin body 49 aids considerably in prolonging the wear life of the pin. However, as described above, when feeding paper of a coarse fiber content the head or tip 50 of the pin 40 can encounter sufficient friction to cause increased wear, should the pin be formed completely of plastic. To obviate this problem, particularly evident in high speed paper feeding, one embodiment of the invention comprises a steel tip implanted in the plastic body. The steel tip 50 shown in FIG. 6 has a stem 51 which is anchored within the plastic body 49 of the pin. In forming the steel pin tip assembly, the plastic pin body 49 is formed about the steel tip stem 51 and allowed to cure. As stated above, the curing process shrinks the pin body by the 0.002 to 0.004 of an inch per inch. While minimal, the shrinkage is sufficient to anchor the pin tip 50 tightly within the pin body 49. For further assurances of a secure fit within the pin body 49, the stem 51 of the steel tip 50 may have an area of decreased radius 52 intermediate stem portions 53 of larger radius for anchoring the tip 50 within the pin body 49.

Such a structure combines the durability of the steel tip 50 in encountering and feeding the paper with the durability and substantially friction-free ride of the plastic pin body 49 so that an extremely long wearing, chatter-free pinwheel assembly is the result. When such a long wearing pin assembly is used in combination with the plastic platen described above, a lightweight durable pinwheel and pin assembly which may be formed inexpensively with a minimum of labor, capable of exacting registration when feeding paper, with a minimum maintenance, regardless of the type or quality of the paper in use is provided.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An improved pinwheel assembly for paper feeding and the like, rotatable about an axis, having a cylinder, a plurality of pins, each of said pins being movably mounted in a seat of a certain diameter in said cylinder and having a follower, said follower being engaged with a camming surface for reciprocal travel in said seat toward and away from said axis of rotation of said pinwheel, each of said pins having a body formed of a high lubricity plastic, said body having a steel tip, integrally mounted within said pin body, said plastic providing a substantially friction-free travel of said pin body in said seat and said steel tip providing an increased wear capability in the feeding of paper, thereby leading to an increased wear life of the entire pinwheel assembly.

2. The pinwheel assembly of claim 1 wherein said pin body is formed of a mixture of fiberglass reinforced polycarbonate and polytetrafluoroethylene.

3. A pinwheel feeding assembly for feeding paper and the like having a platen, a plurality of movable feeding pins, said pins being mounted in sockets in said platen and responsive to a camming assembly for reciprocal travel within said socket, said platen being rotatable for continuously and progressively advancing paper and the like to an associated mechanism, said platen and said camming assembly being formed of a polymeric material, said polymeric material comprising a mixture of fiberglass reinforced polycarbonate and polytetrafluoroethylene, said sockets being integrally formed within said platen and having walls of inherent high lubricity, said reciprocal travel of said pins within said socket being of a smooth continuous chatter-free movement, for a longer wear life of said platen and said pins and a decrease of maintenance of said pinwheel feeding assembly.

4. The pinwheel feeding assembly of claim 3 wherein said polymeric material comprises a mixture of:

28–32% fiberglass,

15–20% polytetrafluoroethylene, and

45–50% polycarbonate.

5. The pinwheel feeding assembly of claim 3 wherein said camming assembly rides directly adjacent a hub of said pinwheel feeding assembly in a smooth frictionless manner.

6. An improved pinwheel assembly rotatable about an axis for paper feeding and the like having a cylinder assembly, a plurality of pins, each of said pins being movably mounted in a seat of a certain diameter in said cylinder assembly and having a follower, said follower being engaged with a camming surface for reciprocal travel in said seat toward and away from said axis of rotation of said pinwheel, each of said pins having a pin body formed of a polymeric material and a pin tip formed of metal, said pin tip being integrally mounted on the end of said pin body opposite said follower, said cylinder assembly being formed of said polymeric material, said polymeric material aiding in the smooth reciprocal travel of said pin in said seat by substantially decreasing all frictional forces of said pin in its reciprocal travel in said seat and thereby substantially increasing the wear life of said pin within said seat.

7. The improved pinwheel assembly of claim 6 wherein said polymeric material comprises a mixture of from 20–40% fiberglass, 10–35% polytetrafluoroethylene and from 30–70% polycarbonate.

8. The improved pinwheel assembly of claim 6 wherein said polymeric material comprises a mixture of from 28–32% fiberglass, 15–20% polytetrafluoroethylene and from45–50% polycarbonate.

9. An improved pin for use in a pinwheel assembly for feeding paper, said pin comprising a pin body mountable in a seat of a pinwheel platen for reciprocal movement within said seat, said pin body having an upper portion and a lower portion, said lower portion having a cam follower for engagement with a cam, said cam driving said pin in said reciprocal movement within said seat, said lower portion being of a lesser cross-sectional dimension than said upper portion, said pin body being formed of a mixture of fiberglass impregnated polycarbonate and polytetrafluoroethylene, said mixture having high lubricity to substantially decrease friction, heat and wear caused by the contact of said pin body with said seat, and thereby allow higher speeds with less wear of said pin body, a steel pin head fixedly mounted on said upper portion, said steel pin head having increased resistance to abrasion caused by the feeding of said paper, said pin body and said steel tip thereby providing a pin of long life, assurances of positive registration, decreased maintenance, and greatly increased speed capabilities.

* * * * *